US005735623A

United States Patent [19]

Gueret

[11] Patent Number: 5,735,623

[45] Date of Patent: Apr. 7, 1998

[54] APPLICATOR ELEMENT FOR VISCOUS COSMETICS, IN PARTICULAR FOR NAIL POLISHES

[75] Inventor: Jean-Louis Gueret, Paris, France

[73] Assignee: L'Oreal, Paris, France

[21] Appl. No.: 916,401

[22] Filed: Aug. 22, 1997

Related U.S. Application Data

[63] Continuation of Ser. No. 584,076, Jan. 11, 1996, abandoned.

[30] Foreign Application Priority Data

Jan. 11, 1995 [FR] France ..... 95 00251

[51] Int. Cl.[6] ..... A46B 11/04; B05B 11/02; A45D 34/04

[52] U.S. Cl. ..... 401/115; 401/129; 401/176; 401/274; 401/272; 401/199

[58] Field of Search ..... 401/115, 100–2, 401/127, 129, 176, 198–9, 186, 205, 272, 274, 280, 283

[56] References Cited

U.S. PATENT DOCUMENTS

| | | | |
|---|---|---|---|
| 2,994,897 | 8/1961 | Snable | 401/186 |
| 3,144,676 | 8/1964 | La Mura | 401/115 X |
| 4,902,152 | 2/1990 | Seidler | 401/117 |
| 5,073,058 | 12/1991 | Fukuoka et al. | 401/206 X |

FOREIGN PATENT DOCUMENTS

| | | | |
|---|---|---|---|
| 0 364 667 | 4/1990 | European Pat. Off. . | |
| 0 630 597 | 12/1994 | European Pat. Off. . | |
| 24 25 062 | 12/1975 | Germany . | |
| 90 04 068.6 | 9/1991 | Germany . | |
| 761065 | 11/1956 | United Kingdom | 401/272 |

*Primary Examiner*—Danton D. DeMille
*Attorney, Agent, or Firm*—Oliff & Berridge, PLC

[57] ABSTRACT

An applicator for a viscous cosmetic has an applicator body constituting a reservoir for the cosmetic. This body contains an applicator element that can be moved between a closed position wherein the applicator element is completely accommodated inside the body and an open position wherein the applicator element projects outside the applicator body. A porous barrier separates the cosmetic in the reservoir from the applicator element. The applicator can be closed by a cap when the applicator element is accommodated inside the body.

17 Claims, 5 Drawing Sheets

APPLICATOR ELEMENT FOR VISCOUS COSMETICS, IN PARTICULAR FOR NAIL POLISHES

This is a Division of application Ser. No. 08/584,076 filed Jan. 11, 1996 now abandoned.

FIELD OF THE INVENTION

The present invention relates to an applicator element for viscous cosmetics, in particular for nail polishes.

BACKGROUND

Viscous cosmetics generally applied with brushes are used in particular for nail polishes.

Such applicators are usually comprised of a bottle which contains the cosmetic, whose cap is provided with a brush or another applicator element which, in the closed position, penetrates into the bottle and is in contact with the cosmetic in the bottle, preventing the cosmetic remaining on the brush after the previous application from thickening.

It is known that such cosmetics are generally comprised of colored or colorless compounds incorporated into solvents of different kinds, possibly aqueous, which cause the cosmetic to dry and harden when they evaporate.

Applicators of this type are extremely simple but have the disadvantage that, when they are used, there is a non-negligible risk of the bottle tipping over when opened and spilling the cosmetic which will damage the user's garments or objects in its vicinity.

To avoid this disadvantage, applicators of the "fountain pen" type have already been proposed, comprised of a body forming a reservoir for the cosmetic composition, of an applicator element such as a brush attached to the body, and a cap whose only purpose is to seal the body.

In this other type of known applicator, the applicator element can be displaced, generally by gravity, between two positions, namely an "out" position in which the cap is separated from the applicator body and an "in" position in which the applicator element is totally contained in the applicator body, with the cap sealing the applicator body and preventing the cosmetic from spilling out.

This second type of applicator facilitates the use of the cosmetic but has the drawback that, when the cap is closed, the applicator element is brought back inside the body with a non-negligible quantity of cosmetic which has already begun to dry and continues to do so while the cap is on the applicator body, due to evaporation of the solvent into the closed space surrounding the applicator element.

This causes a deposit of solidified or highly viscous cosmetic on the applicator element and in the part of the applicator body surrounding it, leading to increasing difficulty in using the cosmetic and to some of it being wasted.

SUMMARY OF THE INVENTION

A goal of the present invention is to make an applicator of the type wherein the applicator element is attached to the body of the applicator element that contains the cosmetic, preventing a solidified or at least highly viscous deposit of the cosmetic on and around the applicator element.

According to the invention, this result can be achieved by the use of simple, effective, and inexpensive means.

The present invention relates to an applicator for a viscous cosmetic such as a nail polish of the type having an applicator body constituting a reservoir for the cosmetic, this body containing an applicator element that can be moved between a closed position wherein the applicator element is completely accommodated inside the body and an open position wherein the applicator element projects outside the body, the applicator body being closed by a cap when the applicator element is in the closed position, said applicator element being characterized in that, in the closed position, a stopper prevents the cosmetic contained in the part of the applicator body constituting the reservoir for the cosmetic from flowing to the part of the applicator body sealed by the cap and containing the applicator element, because of its viscosity; and in that the part of the applicator body containing the cosmetic is connected to the part of the applicator body sealed by the cap and containing the applicator element, by a wall which prevents the cosmetic from flowing but allows the solvent in the cosmetic to pass through such that, in the closed position, this solvent can spread into the space surrounding the applicator element, resisting hardening or increased viscosity of the cosmetic present on the applicator element, on its rod, or on the walls of the space surrounding it.

DETAILED DESCRIPTION OF PREFERRED EMBODIMENTS

Figure 1:
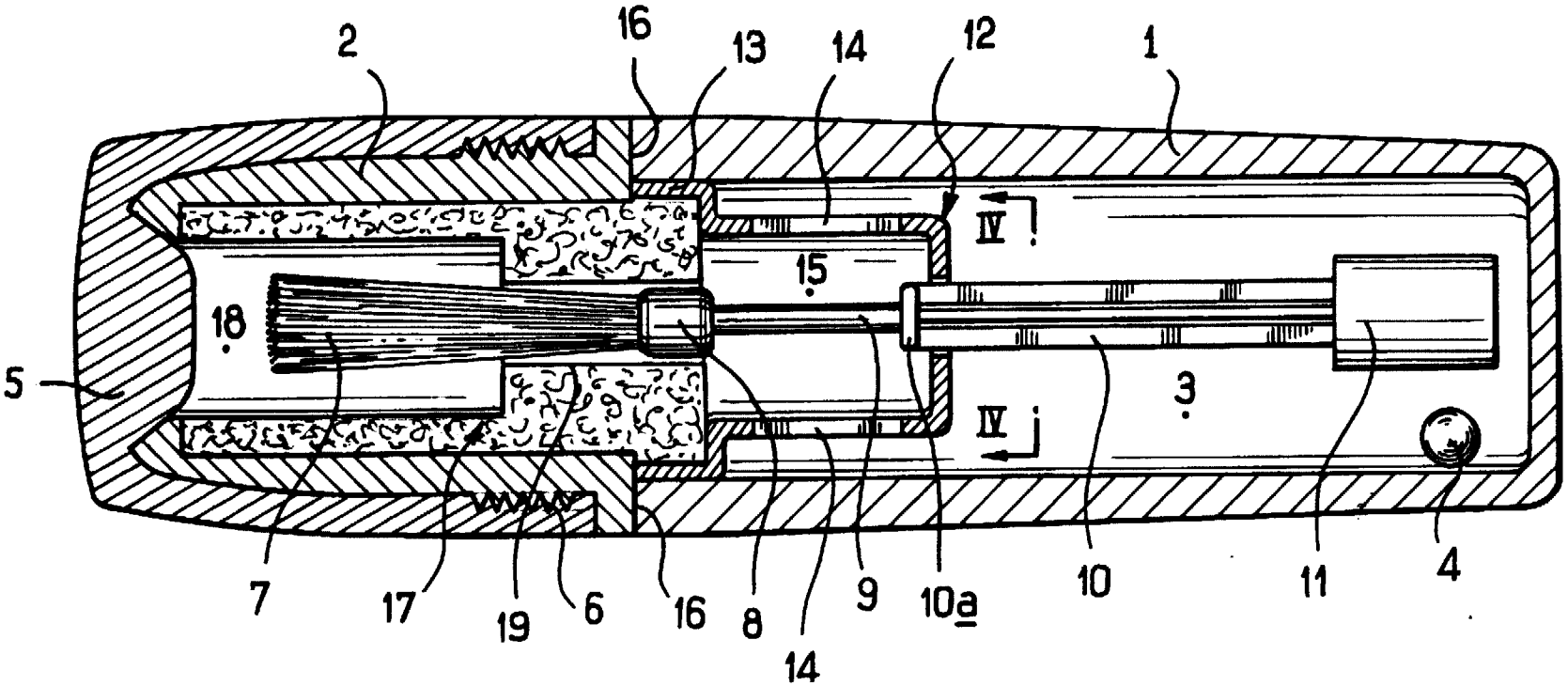
FIG. 1 is a lengthwise section through an applicator according to a first embodiment of the invention, in the non-utilization position.

According to a preferred embodiment of the invention, the wall which allows the solvent to penetrate into the space containing the applicator element is a body of generally tubular shape made of a porous material obtained by sintering for example, part of which can advantageously form, with the applicator element, the stopper between the part of the applicator body containing the cosmetic and the part of this body which, when closed, contains the applicator element.

As a result, this porous wall is in contact at one of its faces with the cosmetic or with the solvent vapors thereof that are inside the applicator body, said solvent migrating through the porous wall to arrive at the part of the applicator body surrounding the applicator element.

At the time the applicator is filled with the cosmetic, it may be advantageous to soak the porous wall with the solvent used in the cosmetic.

In an alternative embodiment, instead of a porous wall, it is possible to use a wall of generally cylindrical or frustroconical shape surrounding the applicator element and which is provided with slots of very small width or holes of very small diameter which, by virtue of capillarity, prevent passage of the cosmetic while allowing passage of the solvent.

In this embodiment, the space outside the wall provided with slots is connected to the part of the applicator body that contains the cosmetic.

According to a preferred embodiment of the invention, the stopper that prevents the cosmetic contained in the rear part of the applicator element from passing into the front part of the applicator body surrounding the applicator element, is constituted by an excess thickness located at the base of the applicator element, which cooperates with the porous or capillary wall which has just been described so that, because of its viscosity, the cosmetic cannot flow from the part of the applicator body where it is contained into the part of the applicator body surrounding the applicator element.

According to a preferred embodiment of the invention, the applicator element is extended rearward by a rod having a recess forming a slide which, when the applicator is open and the applicator element is moved to its utilization position, transfers a given volume of cosmetic into the space located in the front part of the applicator body in order to impregnate the applicator element.

According to another embodiment of the invention, the rod that supports the applicator element is hollow so that the outer wall of the rod can cooperate with part of the surface of the porous wall to resist passage of the cosmetic from the applicator body where it is contained into the space containing the applicator element, while controlled impregnation of the applicator element with the cosmetic can be brought about through the inside of the rod.

For better understanding of the invention, two embodiments taken as examples and shown in the attached drawing will now be described for illustrative purposes and without being limiting.

In the following description, the end of the applicator sealed by the cap will be termed "front part" of the applicator and the other end will be designated "rear part."

In addition, the drawings represent the applicator in the horizontal position but it is clear that, in use, the applicator can be disposed in any position.

For this reason, the cosmetic contained in the applicator has not been shown, because its position depends essentially on the position of the applicator and the agitation that has previously been conferred thereon.

Figure 2:
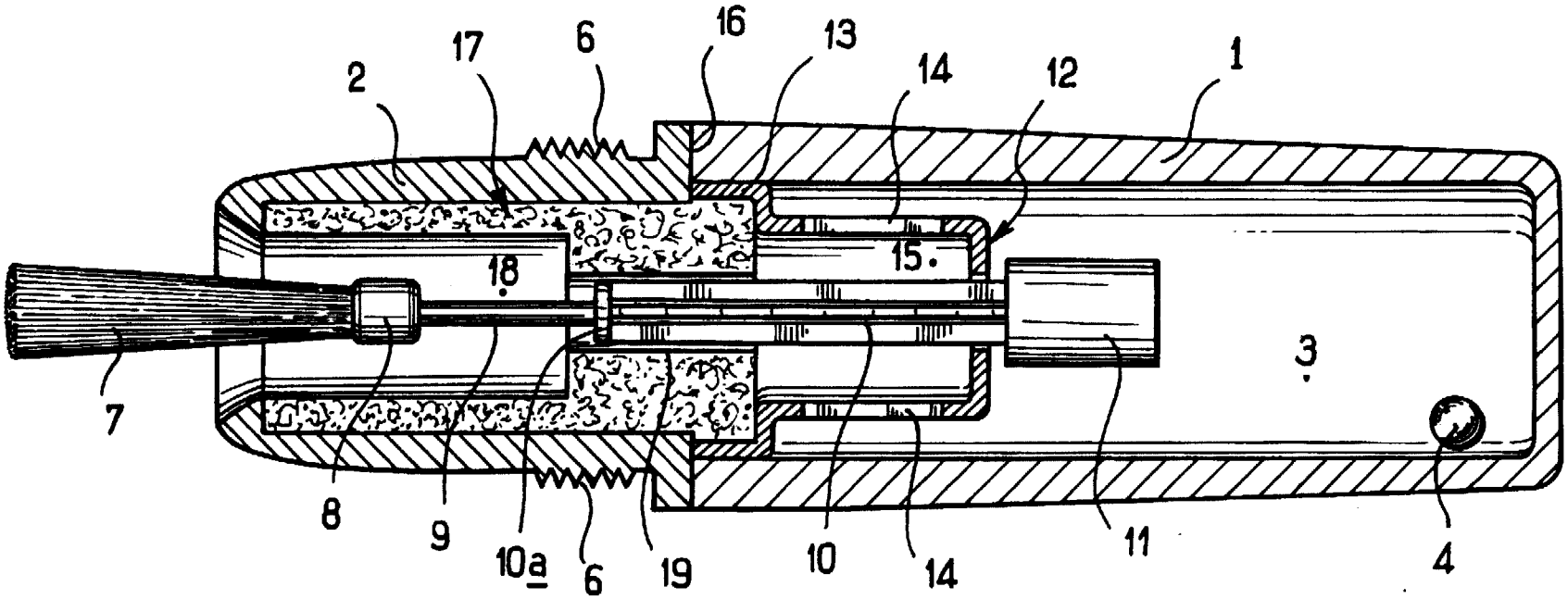
FIG. 2 is a view corresponding to FIG. 1 after removal of the cap and in the utilization position.

FIGS. 1 and 2 show a first embodiment of the applicator according to the invention.

These figures show the body of an applicator which is comprised of a rear part 1 constituting the cosmetic reservoir and a front part 2 provided at its end with an opening.

The cosmetic is thus in the space 3 located inside rear part 1 of the applicator. This space 3 contains in known fashion a metal ball 4 designed to serve as an agitator to homogenize the cosmetic when necessary.

A cap 5 is engaged by screw threads 6 with front part 2 of the applicator body to close off the end orifice of the latter.

The applicator element is comprised of a brush 7 provided at its base with a ferrule 8 whose purpose will be described below. Brush 7 is supported by a rod 9 itself connected to a cruciform slide 10 whose other end has a counterweight 11.

In other embodiments, the shape of the slide can be different, for example square, rectangular, or cylindrical.

Cruciform slide 10 slides in an orifice of matching shape located in a thimble 12, which, at its base 13, is joined to rear part 1 of the applicator body by some means such as gluing.

Openings 14 provided in the wall of thimble 12 allow free passage of the cosmetic between space 3 and space 15 inside thimble 12.

The rear part 1 and front part 2 of the applicator body are connected together in fluidtight fashion at 16 by gluing for example.

According to the invention, a porous wall 17 which, at the front, delimits a space 18 in which the front part of brush 7 is located, is disposed inside front part 2 of the applicator body. This porous wall can be obtained for example by sintering or fiber agglomeration or can be made of a foam.

Between space 18 and space 15 of thimble 12, porous wall 17 has an inner diameter 19 which is greater than the diameter of ferrule 8 located at the base of brush 7.

The relative dimensions of ferrule 8 and part 19 of the porous wall are such that the applicator can move freely between the closed position and the open position despite the viscosity of the cosmetic, while the latter cannot substantially pass from spaces 3 and 15 to space 18 when the applicator is in the closed position, thus constituting a stopper for the cosmetic.

Figure 4:
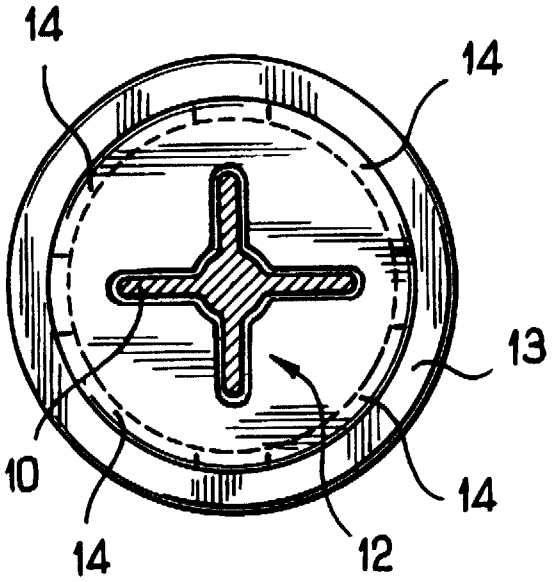
FIG. 4 is a section along line IV—IV in FIG. 1.

FIG. 4 shows the cruciform slide 10 which slides in an orifice of matching shape made in the bottom of thimble 12.

FIG. 4 also shows how wide orifices 14 in the cylindrical part of thimble 12 allow free passage of the cosmetic from space 3 to space 15 located inside thimble 12.

The various parts that have just been described will be found again in FIG. 2, in which cap 5 has been removed while the applicator constituted by brush 7 has been extended.

This movement can be effected in known fashion by agitating the applicator axially, when brush 7 can be brought either into the out position or into the in position due to the inertia of counterweight 11 to which it is connected.

It is assumed that in the case of FIG. 1 the applicator is new and the cosmetic is totally inside the rear part 1 of the applicator body, namely in spaces 3 and 15.

When, after removal of cap 5, the applicator is moved swiftly rightward, brush 7 exits the front part of body 2 of the applicator as shown in FIG. 2 due to the inertia of counterweight 11.

Upon this movement, the cosmetic that surrounds rod 9, which has a substantially smaller diameter than that of ferrule 8 at the base of the brush and of cruciform slide 10, is brought inside space 18 spreading thereto a metered quantity of cosmetic.

If the applicator is moved swiftly leftward, the inertia of counterweight 11 causes brush 7 to move into the position shown in FIG. 1, bringing it into contact with the cosmetic composition which has previously been introduced into space 18 as described above.

Stop **10*a* located at the front end of cruciform slide 10** limits the rearward movement of the applicator element.

A new swift rightward movement of the applicator causes brush 7 to exit once again, this time impregnated with cosmetic which can then be applied by the user.

It will thus be understood that it is possible to coat the brush with given quantities of cosmetic, as needed.

According to one embodiment of the invention, space 18 is delimited by a porous wall 17 whose rear part terminates in space 15 and is thus in contact with the cosmetic.

When application of the cosmetic is complete, brush 7 is brought inside cavity 18, which is then sealed by cap 5.

As explained above, brush 7 still contains a certain quantity of cosmetic whose viscosity has increased because the solvent contained in the cosmetic began to evaporate when it was applied.

But according to the invention, wall 17 is permeable to the solvent so that the latter, which is contained in a greater quantity in the cosmetic present in chambers 3 and 15, diffuses through wall 17 to arrive in space 18 where it dissolves into the cosmetic composition that has remained on brush 7.

This dissolution prevents the residual cosmetic on brush 7 or in space 18 from hardening because it is in the presence of its solvent under exactly the same conditions as the cosmetic located in spaces 3 and 15.

The equilibrium between the cosmetic and its solvent is thus reestablished in chamber 18, preventing accumulation of highly viscous or even solidified cosmetic on brush 7 and on the wall of space 18.

According to the invention, it is advantageous to make ferrule 8, at the base of brush 7, of a porous material, which, like wall 17, allows the solvent to penetrate from the cosmetic in order further to facilitate passage of said solvent to brush 7 and space 18.

Figure 3:
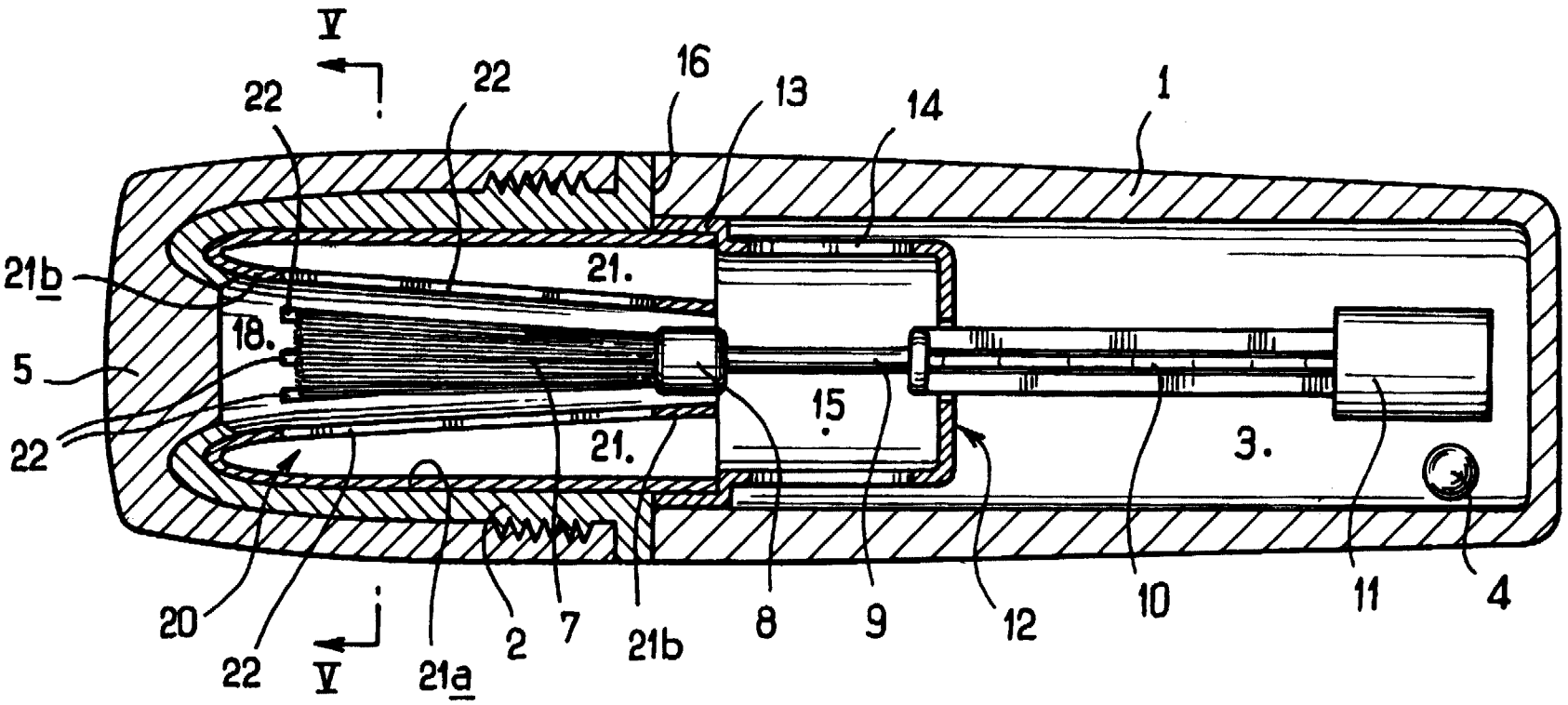
FIG. 3 represents, in lengthwise section, an applicator according to a second embodiment of the invention.

In the embodiment in FIG. 3, porous wall 17 is replaced by a part 20 comprised of two walls 21*a* and 21*b* which delimit between them an annular space 21 which communicates with spaces 15 and 3 described above.

inside wall 21*b* is provided with narrow, lengthwise slots 22 which, because of their size, allow passage of the solvent contained in the cosmetic but due to their capillarity prevent the cosmetic from passing through them.

It can be seen that part 20 plays the same role as porous wall 17 by allowing passage of the solvent from spaces 15 and 3 to space 18 in which the residual cosmetic must not thicken, while preventing the cosmetic retained in spaces 3 and 15 from penetrating into space 18.

Figure 5:
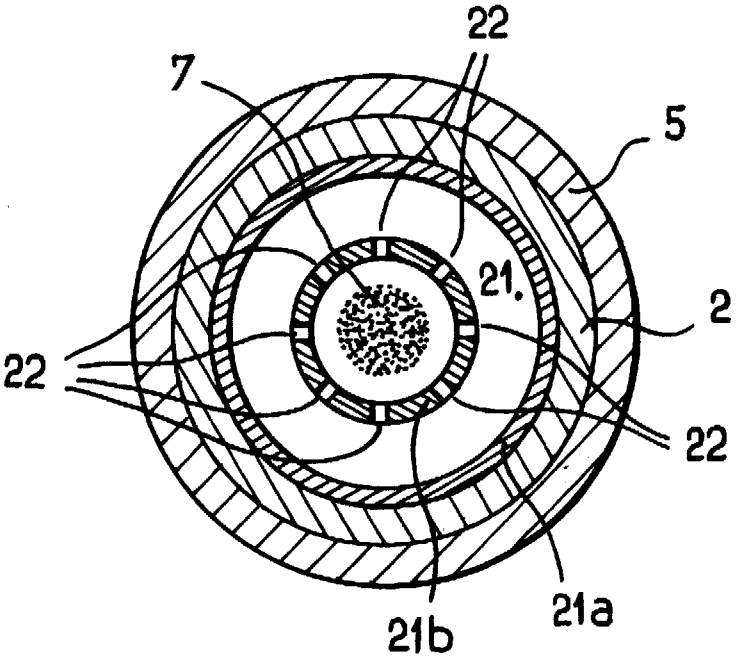
FIG. 5 is a section along V—V in FIG. 3.

FIG. 5, which is a section along line V—V in FIG. 3, shows cap 5, front part 2 of the applicator, and walls 21*a* and 21*b* which delimit annular space 21.

It also shows narrow slots 22 provided in wall 21*b* to allow passage of the solvent but not passage of the cosmetic.

Figure 6:
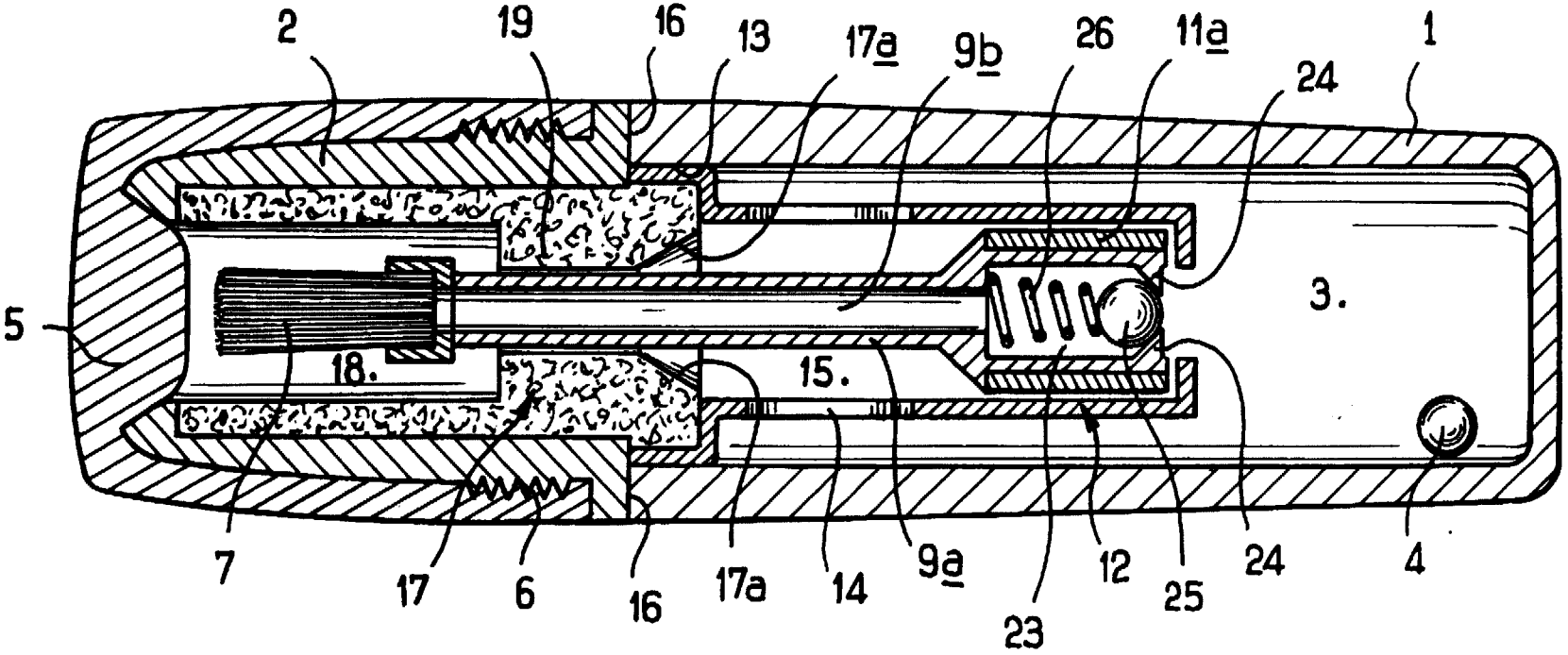
FIG. 6 is a view in lengthwise section of an applicator according to a third embodiment of the invention.

According to the third embodiment in FIG. 6, the applicator element is comprised of a brush 7 supported by a rod 9*a* which is hollow and whose inner passage 9*b* provides a link between brush 7 and space 3 of body 1 through a widened part 23 which has a circular lip 24 against which a ball 25 urged by a spring 26 presses to form a valve.

This being the case, it will be understood that when cap 5 is removed, by pressing the flexible body 1 of the applicator, one can extend brush 7, push back ball 25, and feed the brush with the cosmetic flowing into passage 9*b* of rod 9.

In one variant, space 3 of the applicator body has been changed by having it form two parts movable with respect to each other.

A ring-shaped counterweight 11*a* allows brush to retract or emerge by inertia.

FIG. 6 also shows how the outer surface of rod 9*a* cooperates with surface 19 of porous wall 17 to prevent the cosmetic from flowing from spaces 3 and 15 into space 18.

Transfer of solvent from spaces 15 and 3 to space 18 does not imply that the solvent remain either liquid or gaseous when this transfer takes place. However, in view of its volatility, which allows the cosmetic to dry relatively rapidly, the solvent generally passes through the wall in the vapor form in order to balance its vapor pressure in all the spaces inside the body of the container.

It is understood that the embodiments described are not limiting in nature and may receive any desirable modifications without thereby departing from the framework of the invention whose essential feature is comprised of the communication provided between the space containing the applicator element in the closed position with the space containing the cosmetics such that the latter cannot flow from the space containing the applicator element but its solvent can pass from the part of the applicator containing the cosmetic into the part containing the applicator element, thus preventing the cosmetic left on or surrounding the applicator element from thickening and hardening.

In particular it is clear that the applicator can be made in some other manner than in the shape of a brush, for example with the aid of a porous element or one provided with fine lengthwise channels able to retain the cosmetic by capillarity. This applicator can also be made of foam for example or a plastic made by sintering or flocking.

It is also possible to make the stopper which in the closed position prevents the cosmetic contained at the rear of the applicator body from moving into the front space in which the applicator element is located, in some other fashion.

Finally it goes without saying the invention can be applied to an applicator for a product other than a cosmetic but one which has the same viscosity and solvent characteristics.

I claim:

1. An applicator for a viscous cosmetic, comprising:

an applicator body having a front part defining a cavity and a rear part comprising a reservoir for the cosmetic;

a passage connecting said reservoir to said cavity, an applicator element that can be moved between a closed position, wherein the applicator element is completely accommodated inside the cavity, and an open position, wherein the applicator element projects outside the body, said cavity being closeable by a cap when the applicator element is accommodated inside the cavity, a rod supporting said applicator element, said rod coming through the passage and having a diameter smaller than that of the passage, so that upon movement of the applicator element from its closed position to its open position, a metered quantity of cosmetic which surrounds the rod inside the reservoir in the closed position of the applicator element is brought inside the cavity, the rod and passage being dimensioned so that said metered quantity of cosmetic is substantially just enough to impregnate the applicator element so that the cavity is never completely filled with cosmetic, a stopper supported by the rod, positioned so that it is located in the passage when the applicator element is in its closed position, and dimensioned in such a way that it lets the rod move freely between the closed position and the open position of the applicator element despite the viscosity of the cosmetic, while the cosmetic cannot substantially pass from the reservoir to the cavity when the applicator element is in the closed position, so that the quantity of cosmetic in the cavity is limited to the metered quantity brought by the rod upon movement of the applicator element from its closed position to its open position, said applicator body front part containing said applicator element when said applicator is in the closed position, a wall provided between said reservoir and said cavity, said wall preventing cosmetic from flowing past said wall but allowing solvent to move through said wall such that, in the closed position, solvent can spread into the cavity, resisting hardening or increased viscosity of residual cosmetic remaining in said cavity and on said applicator element after an application of the cosmetic, the wall being configured to substantially contain the applicator element when the applicator is in the closed position.

2. The applicator according to claim 1, wherein said wall comprises a rear portion that is disposed around said applicator element when said applicator element is in said closed position.

3. The applicator according to claim 2, wherein said stopper comprises said rear portion of said wall and a ferrule integral with said applicator element.

4. The applicator according to claim 2, wherein the rod is attached to said applicator element and said stopper comprises said rod and said rear portion of said wall.

5. The applicator according to claim 1, wherein said wall comprises porous material.

6. The applicator according to claim 1, wherein said wall comprises a solid material provided with capillary slots of small width or holes of small diameter wherein viscosity of cosmetic prevents flow of cosmetic through said slots or holes.

7. The applicator according to claim 1, wherein the rod is attached to said applicator element and said rod has a recess forming a slide such that when said applicator element is moved into said open position, a metered amount of cosmetic is transferred into said space at a location near said applicator element to impregnate said applicator element with cosmetic.

8. The applicator according to claim 1, wherein said rod is attached to said applicator element and said rod is hollow and supports said applicator element, said rod having a valve controlling delivery of cosmetic to said applicator element by reducing the volume of the applicator body.

9. The applicator according to claim 3, wherein said ferrule is located at a base of said applicator element and is made of a porous material.

10. The applicator according to claim 1, wherein said applicator element comprises a brush.

11. The applicator according to claim 5, wherein said porous material is formed by sintering.

12. The applicator according to claim 5, wherein said porous material is formed by fiber agglomeration.

13. The applicator according to claim 8, wherein said delivery is accomplished by reducing a delivery volume of said reservoir.

14. The applicator according to claim 13, wherein reducing said volume results from deforming said applicator.

15. The applicator according to claim 1, wherein said applicator contains a cosmetic.

16. The applicator according to claim 15, wherein said cosmetic is a fingernail polish.

17. An applicator for a viscous cosmetic, comprising:

an applicator body having a front part defining a cavity and a rear part defining a reservoir for the cosmetic;

a passage connecting said reservoir to said cavity, an applicator element that can be moved between a closed position wherein the applicator element is completely accommodated inside the cavity, and an open position wherein the applicator element projects outside the body, said cavity being closeable by a cap when the applicator element is accommodated inside the cavity, a rod supporting said applicator element, said rod coming through the passage and having a diameter smaller than that of the passage, so that upon movement of the applicator element from its closed position to its open position, a metered quantity of cosmetic which surrounds the rod inside the reservoir in the closed position of the applicator element is brought inside the cavity, the rod and passage being dimensioned so that said metered quantity of cosmetic is substantially just enough to impregnate the applicator element so that the cavity is never completely filled with cosmetic, a stopper supported by the rod, positioned so that it is located in the passage when the applicator element is in its closed position, and dimensioned in such a way that it lets the rod move freely between the closed position and the open position of the applicator element despite the viscosity of the cosmetic, while the cosmetic cannot substantially pass from the reservoir to the cavity when the applicator element is in the closed position, so that the quantity of cosmetic in the cavity is limited to the metered quantity brought by the rod upon movement of the applicator element from its closed position to its open position, said applicator body front part containing said applicator element when said applicator is in the closed position, a wall provided between said reservoir and said cavity, said wall preventing cosmetic from flowing past said wall but allowing solvent to move through said wall such that, when the applicator element is in the closed position, solvent can spread into the cavity, resisting hardening or increased viscosity of residual cosmetic remaining in said cavity and on said applicator element after an application of the cosmetic, the front part of the applicator defining a cavity which is open to air when the applicator is in the open position, said cavity having an internal surface which is substantially comprised of the wall which prevents cosmetic from flowing but allows solvent to move therethrough, the internal surface substantially containing the applicator element when the applicator is in the closed position.

* * * * *